US012569911B2

(12) United States Patent
Fukai et al.

(10) Patent No.: US 12,569,911 B2
(45) Date of Patent: Mar. 10, 2026

(54) COMPOSITION FOR USE IN SINTERED MOLDED BODIES AND SINTERED MOLDED BODY

(71) Applicant: ASAHI KASEI KABUSHIKI KAISHA, Tokyo (JP)

(72) Inventors: Motohiro Fukai, Tokyo (JP); Kuon Miyazaki, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 116 days.

(21) Appl. No.: 18/553,571

(22) PCT Filed: Mar. 16, 2022

(86) PCT No.: PCT/JP2022/012080
§ 371 (c)(1),
(2) Date: Oct. 2, 2023

(87) PCT Pub. No.: WO2022/215472
PCT Pub. Date: Oct. 13, 2022

(65) Prior Publication Data

US 2024/0189898 A1 Jun. 13, 2024

(30) Foreign Application Priority Data

Apr. 7, 2021 (JP) ..... 2021-065481

(51) Int. Cl.
*B22F 1/103* (2022.01)
*B22F 3/02* (2006.01)

(52) U.S. Cl.
CPC ..... *B22F 1/103* (2022.01); *B22F 3/02* (2013.01); *B22F 2301/35* (2013.01)

(58) Field of Classification Search
None
See application file for complete search history.

(56) References Cited

U.S. PATENT DOCUMENTS

| | | | | |
|---|---|---|---|---|
| 5,155,158 | A | 10/1992 | Kim | |
| 5,198,489 | A | 3/1993 | Sterzel et al. | |
| 5,362,791 | A | 11/1994 | Ebenhoech et al. | |
| 6,051,184 | A | 4/2000 | Kankawa | |
| 2013/0133481 | A1 | 5/2013 | Hamakura et al. | |
| 2015/0068361 | A1 | 3/2015 | Thomas et al. | |
| 2016/0122502 | A1* | 5/2016 | Uibel | C08K 3/38 524/404 |
| 2018/0298305 | A1 | 10/2018 | Thomas et al. | |
| 2021/0229174 | A1* | 7/2021 | Ahlin | C04B 35/632 |
| 2021/0309851 | A1* | 10/2021 | Zhang | C04B 35/584 |

FOREIGN PATENT DOCUMENTS

| | | | | | |
|---|---|---|---|---|---|
| CN | 105722624 | A | | 6/2016 | |
| CN | 108746629 | A | | 11/2018 | |
| CN | 109226742 | A | | 1/2019 | |
| CN | 111454067 | A | | 7/2020 | |
| CN | 111606722 | A | | 9/2020 | |
| CN | 112135702 | A | | 12/2020 | |
| CN | 113337749 | A | * | 9/2021 | C22C 1/08 |
| JP | H04247802 | A | | 9/1992 | |
| JP | H0598306 | A | | 4/1993 | |
| JP | H05125403 | A | | 5/1993 | |
| JP | H05126403 | A | | 5/1993 | |
| JP | H06107449 | A | | 4/1994 | |
| JP | H06158107 | A | | 6/1994 | |
| JP | H09111306 | A | | 4/1997 | |
| JP | H11343503 | A | | 12/1999 | |
| JP | 2000109904 | A | | 4/2000 | |
| JP | 2003212942 | A | | 7/2003 | |
| JP | 2013112887 | A | | 6/2013 | |
| JP | 5249213 | B2 | | 7/2013 | |
| JP | 2014069975 | A | | 4/2014 | |
| JP | 2015001010 | A | | 1/2015 | |
| JP | 2019056178 | A | | 4/2019 | |
| JP | 2019104775 | A | | 6/2019 | |
| JP | 2020041133 | A | | 3/2020 | |
| JP | 2021109994 | A | | 8/2021 | |
| WO | 9714524 | A1 | | 4/1997 | |
| WO | 2006003703 | A1 | | 1/2006 | |
| WO | 2019219522 | A1 | | 11/2019 | |

OTHER PUBLICATIONS

English machine translation of CN 109226742, EPO, accessed Feb. 10, 2025.*
English machine translation of CN 111606722, EPO, accessed Feb. 10, 2025.*
English machine translation of JP 2019-104775, EPO, accessed Feb. 10, 2025.*
Sep. 25, 2024, the Supplementary European Search Report issued by the European Patent Office in the corresponding European Patent Application No. 22784457.8.
May 31, 2022, International Search Report issued in the International Patent Application No. PCT/JP2022/012080.
Oct. 10, 2023, International Preliminary Report on Patentability issued in the International Patent Application No. PCT/JP2022/012080.

* cited by examiner

*Primary Examiner* — Xiaobei Wang
(74) *Attorney, Agent, or Firm* — KENJA IP LAW PC

(57) ABSTRACT

An object of the present disclosure is to provide a composition for use in sintered molded bodies which does not impair the shape retention ability of a green molded body relying on the rigidity inherent to a polyacetal resin, has high fluidity, and is resistant to cracking or swelling during degreasing. The composition for use in sintered molded bodies contains a sinterable inorganic powder and an organic binder, the organic binder contains at least a polyacetal resin and a polyolefin resin, and the melt flow index of the polyacetal resin is 70 to 200 g/10 min.

20 Claims, No Drawings

COMPOSITION FOR USE IN SINTERED MOLDED BODIES AND SINTERED MOLDED BODY

TECHNICAL FIELD

The present disclosure relates to a raw material for molding used for the production of a sintered molded body.

BACKGROUND

Sintered molded bodies that are particularly precise and sintered molded bodies having complex shapes are made from sinterable powders of metals, ceramics, cermets, or the like. Such molded bodies are produced as follows. A composition for used in the production of sintered molded bodies containing a sinterable powder and a binder is heated and kneaded to produce a raw material for sintered molded bodies, which is then injection molded to produce green molded bodies. Subsequently, the resultant green molded bodies are subjected to a degreasing step.

In molding of sintered molded bodies by the method described above, the most important step for producing good quality molded bodies without defects such as cracks, swells, or deformations is the degreasing step. This degreasing step is the step to remove a binder from green molded bodies made of injection molded bodies. This step employs either the method in which green molded bodies are heated to thermally decompose and gasify the binder, or the method in which green molded bodies are treated with a solvent to elute or remove a soluble binder component in the green molded bodies and then the remaining binder is thermally decomposed and gasified. In the thermal degreasing method where the green molded bodies are degreased by heating, if the binder in the green molded bodies thermally is decomposed and gasified in a short period of time, cracks or swells would occur in the molded bodies during the degreasing step. Degreasing, therefore, must be achieved by long-time heating.

It has been known that, when a polyacetal resin, which is a depolymerized polymer, is used alone or in combination with other polymers as a binder, excellent shape retention ability of a green molded body is achieved relying on the rigidity inherent to the polyacetal resin, excellent shape retention ability of a molded body in the thermal degreasing step is achieved, no residue remains after the thermal degreasing step, and the thermal degreasing step is shortened, which improves the production efficiency (for example, JP H4-247802 A, JP H5-98306 A, etc.).

SUMMARY

Technical Problem

However, the methods described in JP H4-247802 A, JP H5-98306 A, etc. have a problem in that the fluidity of commercially available high-fluidity polyacetal resins indicated by the melt flow index is about 45 g/10 min, and the use of a binder containing a polyacetal resin in a large amount decreases the fluidity of the feedstock, resulting in poor moldability, especially for products with thin portions. The fluidity of a binder containing a polyacetal resin can be increased by adding a flow aid such as wax in a large amount. However, adding a single component in a large amount may lead to rapid volatilization during degreasing, thereby causing cracking and swelling.

Furthermore, for example, the acid degreasing method described in JP 5249213 B where a green molded body is degreased using an acid such as nitric acid proposes a binder composition with improved fluidity containing a polyacetal resin containing 2 mol % of 1,3-dioxepane, polyethylene, and poly-1,3-dioxepane. However, the fluidity of the polyacetal resin is not disclosed, and it is assumed that the above polyacetal resin described in Examples has low fluidity, making it difficult to produce a thin molded body having a thickness of 1 to 2 mm when compounded with a metal powder.

In addition, if the concentration of 1,3-dioxepane is increased to increase the fluidity of the above polyacetal resin, the strength of the polyacetal resin is lowered and the strength of a molded body obtained by compounding with a metal powder and performing injection molding is reduced.

Therefore, an object of the present disclosure is to provide a composition for use in sintered molded bodies which does not impair the shape retention ability of a green molded body relying on the rigidity inherent to a polyacetal resin, has high fluidity, and is resistant to cracking or swelling during degreasing.

Solution to Problem

As a result of diligent study to solve the above-mentioned problem, the present inventors have found that the above-mentioned problem can be solved by a composition for use in sintered molded bodies containing an organic binder containing a polyacetal resin having a certain melt flow index and a polyolefin resin, thereby completing the present disclosure.

Thus, the present disclosure is as follows.

[1]

A composition for use in sintered molded bodies comprising:

a sinterable inorganic powder and an organic binder, wherein the organic binder comprises at least a polyacetal resin and a polyolefin resin, and a melt flow index of the polyacetal resin is 70 to 200 g/10 min.

[2]

The composition for use in sintered molded bodies according to [1], wherein a melt flow index (190° C., 2.16 kg) of the polyolefin resin is 40 g/10 min or more.

[3]

The composition for use in sintered molded bodies according to [1] or [2], wherein 5 to 95 mass % of the polyacetal resin and 5 to 95 mass % of the polyolefin resin are contained in the organic binder, based on a mass of the organic binder.

[4]

The composition for use in sintered molded bodies according to any one of [1] to [3], wherein 70 to 95 parts by mass of the sinterable inorganic powder is contained when the composition for use in sintered molded bodies is taken as 100 parts by mass.

[5]

The composition for use in sintered molded bodies according to any one of [1] to [4], wherein 5 to 60 mass % of a fluidity imparting agent is contained in the organic binder, based on the mass of the organic binder.

[6]

The composition for use in sintered molded bodies according to any one of [1] to [5], wherein the polyacetal resin comprises an oxymethylene unit and an oxyethylene unit.

[7]

The composition for use in sintered molded bodies according to any one of [1] to [6], wherein 5 to 50 mass % of the polyacetal resin is contained, based on the mass of the organic binder.

[8]

The composition for use in sintered molded bodies according to any one of [1] to [7], wherein the organic binder comprises a nitrogen-containing compound and a fatty acid metal salt.

[9]

A green molded body produced by molding the composition for use in sintered molded bodies according to any one of [1] to [8].

[10]

The green molded body according to [9], wherein a portion with a thickness of 1 mm or less is present at 100 $mm^2$ or more.

Advantageous Effect

According to the present disclosure, it is possible to provide a composition for use in sintered molded bodies which does not impair the shape retention ability of a green molded body relying on the rigidity inherent to a polyacetal resin, has high fluidity, and does not cause cracking or swelling when degreasing.

The composition for use in sintered molded bodies of the present disclosure facilitates molding of thin molded bodies and has good degreasability, enabling production of sintered molded bodies with high yield.

DETAILED DESCRIPTION

The following provides details of an embodiment to implement the present disclosure. Note that the present disclosure is not limited by the description given below, and may be implemented with various changes or modifications that are within the essential scope thereof.

[Composition for Use in Sintered Molded Bodies]

In the present embodiment, a composition for use in sintered molded bodies contains a sinterable inorganic powder and an organic binder, and preferably consists of the above inorganic powder and the above organic binder.

In addition to the above inorganic powder and the above organic binder, the above composition for use in sintered molded bodies may also contain other additives.

<Organic Binder>

The above organic binder contains a polyacetal resin and a polyolefin resin.

The polyacetal resin and the polyolefin resin have different thermal decomposition start points. This allows the organic binder to be gradually removed from a green molded body during the temperature increase stage during thermal degreasing. Alternatively, in acid degreasing, the polyacetal resin is decomposed by an acid such as nitric acid and is removed from a green molded body. By blending a polyolefin resin, which is not decomposed by an acid, the green molded body from which the polyacetal resin has been removed can retain its shape.

It is preferred that resin components contained in the above organic binder are only the above polyacetal resin, the above polyolefin resin, a fluidity imparting agent to be described later, and a nitrogen-containing compound (e.g., a polyamide resin) to be described later.

From the viewpoint of keeping good moldability during injection molding and further suppressing cracking and swelling during the degreasing step, the mass ratio of the above organic binder in the above composition for use in sintered molded bodies is preferably 5 to 30 parts by mass, more preferably 5 to 20 parts by mass, and even more preferably 5 to 15 parts by mass, with respect to 100 parts by mass of the above composition for use in sintered molded bodies.

(Polyacetal Resin)

Examples of the above polyacetal resin include polyacetal homopolymers, polyacetal copolymers, or mixtures thereof. Among these, polyacetal copolymers are preferred from the viewpoint of thermal stability.

One of the above polyacetal resins may be used alone, or two or more of these may be used in combination.

Examples of the above polyacetal homopolymers include polymers having an oxymethylene unit in the main chain, and both ends of the polymer can be capped by ester or ether groups. Polyacetal homopolymers can be produced from formaldehyde and a known molecular weight modifier used as raw materials, and can be produced from these raw materials using a known onium salt-based polymerization catalyst in a solvent such as a hydrocarbon, by a known slurry method, such as the polymerization methods described in JP S47-6420 B and JP S47-10059 B, for example.

In the polyacetal homopolymer, it is preferable that 99.8 mol % or more of the main chain excluding both ends is composed of an oxymethylene unit, and it is more preferable that the polyacetal homopolymer is a polyacetal homopolymer of which main chain excluding both ends is composed only of an oxymethylene unit.

Examples of polyacetal copolymers include polymers having an oxymethylene unit and an oxyethylene unit in the main chain, and they can be produced through copolymerization of trioxane with a cyclic ether and/or a cyclic formal in the presence of a polymerization catalyst, for example. Trioxane is a cyclic trimer of formaldehyde, and is typically produced through a reaction of an aqueous solution of formalin in the presence of an acidic catalyst.

Because the above trioxane may contain impurities having chain transferring capability, such as water, methanol, formic acid, methyl formate, and other impurities, these impurities are preferably removed to purify trioxane by means of distillation, for example. In the purification, the total amount of impurities having chain transferring capability is preferably reduced to $1\times10^{-3}$ mol or less, and more preferably to $0.5\times10^{-3}$ mol or less, per 1 mol of trioxane. By setting the total amount of impurities to a low value as the above-described values, the rate of the polymerization reaction can be increased sufficiently for practical use and an excellent thermal stability can be imparted to a resultant polymer.

A cyclic ether and/or cyclic formal are substances that can be copolymerized with the trioxane, and examples thereof includes ethylene oxide, propylene oxide, butylene oxide, epichlorohydrin, epibromohydrin, styrene oxide, oxatane, 1,3-dioxolane, ethylene glycol formal, propylene glycol formal, diethylene glycol formal, triethylene glycol formal, 1,4-butanediol formal, 1,5-pentanediol formal, and 1,6-hexanediol formal. Ethylene oxide and 1,3-dioxolane are particularly preferred. They may be used alone or in a combination of two or more.

The amount of the cyclic ether and the cyclic formal added is preferably 1.0 mol % or more, more preferably 3.0 mol % or more, and even more preferably 3.5 mol % or more with respect to 1 mol of the above trioxane. In addition, the amount is preferably 8.0 mol % or less, more preferably 7.0 mol % or less, and even more preferably 5.0 mol % or less with respect to 1 mol of the above trioxane.

Examples of the polymerization catalysts include boric acid, tin, titanium, phosphorus, arsenic, and antimony compounds represented by Lewis acids, and in particular, preferred are boron trifluoride, boron trifluoride hydrates, and coordination complex compounds of boron trifluoride with organic compounds containing oxygen or sulfur atoms. For example, boron trifluoride, boron trifluoride diethyl etherate, and boron trifluoride-di-n-butyl etherate are exemplified as suitable examples. They may be used alone or in a combination of two or more.

The amount of the polymerization catalyst added is preferably in a range from $0.1\times10^{-5}$ to $0.1\times10^{-3}$ mol, more preferably in a range from $0.3\times10^{-5}$ to $0.3\times10^{-4}$ mol, and even more preferably in a range from $0.5\times10^{-5}$ to $0.4\times10^{-4}$ mol, with respect to 1 mol of the above trioxane. When the amount of polymerization catalyst added is within any of the above ranges, a long-time polymerization reaction can be stably carried out.

In the production of a polyacetal copolymer, the deactivation of the polymerization catalyst is achieved by charging the polyacetal resin obtained through the polymerization reaction into an aqueous solution or organic solvent solution containing at least one catalyst neutralization deactivator, e.g., amines such as ammonia, triethylamine, or tri-n-butylamine, or a hydroxide of alkali metals or alkaline earth metals, inorganic salts, or organic salts, and stirring the mixture in the slurry state for several minutes to several hours. After catalyst neutralization deactivation, the slurry is filtered and washed to remove unreacted monomers, the catalyst neutralization deactivator, and the catalyst neutralization salt, and then dried.

Alternatively, to deactivate the polymerization catalyst, the method in which vapor of ammonia, triethylamine, or the like is brought into contact with the polyacetal copolymer, or the method in which at least one of hindered amines, triphenylphosphine, calcium hydroxide, and the like is brought into contact with the polyacetal resin in a mixing machine may also be used.

Alternatively, without deactivating the polymerization catalyst, an end stabilization process to be described later may also be performed using a polyacetal copolymer in which the amount of the polymerization catalyst is reduced through volatilization by heating at a temperature of the melting point of the polyacetal copolymer or below in an inert gas atmosphere. The above-described polymerization catalyst deactivation operation and the polymerization catalyst volatilization reduction operation may be performed after pulverizing the polyacetal resin obtained through the polymerization reaction, if necessary.

The end stabilization treatment of the resulting polyacetal resin involves decomposition and removal of unstable ends by the following method. As the method of decomposition and removal of unstable ends, for example, a single screw extruder with a vent or a twin screw extruder with a vent is used to melt the polyacetal resin and decompose and remove unstable ends in the presence of a known basic substance that can decompose unstable ends, e.g., ammonia, fatty acid amines such as triethylamine and tributylamine, hydroxides of alkali metals or alkaline earth metals such as calcium hydroxide, inorganic weak acids, and organic weak acids as a cutting agent.

The mass ratio of the above polyacetal resin in the above organic binder is preferably 5 to 95% by mass, more preferably 5 to 70% by mass, and particularly 5 to 60% by mass, with respect to 100% mass of the organic binder.

In cases where the organic binder is removed from a green molded body by heating, the mass ratio of the polyacetal resin is preferably 5 to 50% by mass, more preferably 5 to 45% by mass, and particularly preferably 10 to 40% by mass, with respect to 100% by mass of the organic binder.

When the ratio of the polyacetal resin in the organic binder is set to any of the above ranges, the shape of the green molded body tends to be favorably retained.

The melt flow index of the above polyacetal resin is preferably 70 g/10 min or more and 200 g/10 min or less, more preferably 90 g/10 min or more and less than 200 g/10 min, and even more preferably 90 g/10 min or more and less than 140 g/10 min, as measured under the conditions of 190° C., 2.16 kg in accordance with ASTM-D-1238-57T. A melt flow index of 70 g/10 min or more improves the fluidity of the composition for use in sintered molded bodies, and a melt flow index of 200 g/10 min or lower improves the strength of a green molded body.

Note that the melt flow index of the polyacetal resin can be adjusted to be high by increasing the amount of a molecular weight modifier (e.g., methylal, methanol, formic acid, or methyl formate) added upon polymerization.

The melting point of the above polyacetal resin is preferably from 100 to 200° C., more preferably from 140 to 180° C. The above melting point is the peak melting temperature as measured according to JIS K7121, or the melting point on the high-temperature side if there are multiple melting temperatures.

(Polyolefin Resin)

The above polyolefin resin is a homopolymer or a copolymer having structural units derived from an alkene having a carbon number of 2 to 8, preferably a carbon number of 2 to 4.

The melt flow index of the above polyolefin resin is preferably 40 g/10 min or more, measured the conditions of 190° C. 2.16 kg, from the viewpoint of mixability with the polyacetal resin and the sinterable inorganic powder and injection moldability. It is more preferably 50 g/10 min or more, even more preferably 70 g/10 min or more, and particularly preferably 80 g/10 min or more. When the melt flow index of the polyolefin resin is greater than the lower limit mentioned above, more excellent thin moldability and better degreasability upon thermal degreasing tend to be achieved. The melt flow index of the polyolefin resin is preferably 200 g/10 min or less and more preferably 150 g/10 min or less from the viewpoint of achieving good strength of the molded body.

Specific examples of the above polyolefin resin include polyethylene, polypropylene, ethylene-propylene copolymer, ethylene-vinyl acetate copolymer, ethylene-vinyl alcohol copolymer, polyisoprene, and polybutadiene. Polyethylene, polypropylene, and mixtures thereof are preferred, and polyethylene or polypropylene is more preferred in terms of shape retention ability in the degreasing step and prevention of cracking and swelling in the degreasing step. Examples of commercially available products that can be suitably used include SUNTEC HD series (manufactured by Asahi Kasei Corporation), SUNTEC LD series (manufactured by Asahi Kasei Corporation), and SUNTEC EVA series (manufactured by Asahi Kasei Corporation), and NEO-ZEX, ULTZEX, and Evolue (above are manufactured by Prime Polymer Co., Ltd.) as polyethylene; and Sumitomo NOBLEN (manufactured by Sumitomo Chemical Co., Ltd.), NOVATEC PP (manufactured by Japan Polypropylene Corporation), SunAllomer PM series (manufactured by SunAllomer Ltd.), and Prime Polypro (manufactured by Prime Polymer Co., Ltd.) as polypropylene, for example.

The above polyolefin resin is preferably resistant to degradation by an acid from the viewpoint of shape retention ability of a molded body after acid degreasing. From the viewpoint of the shape retention ability of a molded body after acid degreasing, it is preferable that the weight of the above polyolefin resin after immersed in a 30%-nitric acid solution under a condition of 23° C. (room temperature), 70° C. for 24 hours according to the method described in JIS K 7114 is preferably 10% or less, more preferably 5% or less, particularly preferably 1% or less of the weight before immersion.

From the viewpoint of favorably retaining the shape of a green molded body and the shape of a molded body after acid degreasing, the mass ratio of the above polyolefin resin in the above organic binder is preferably 5 to 95 mass %, more preferably 5 to 70 mass %, and particularly preferably 5 to 60% by mass.

The mass ratio of the above polyolefin resin with respect to 100 parts by mass of the above polyacetal resin is preferably 1 to 200 parts by mass, more preferably 5 to 150 parts by mass, and even more preferably 10 to 120 parts by mass.

The ratio of the total mass of the above polyacetal resin and the above polyolefin resin in 100 mass % of the above organic binder is preferably 45 mass % or more. In addition, the ratio of the total mass of the above polyacetal resin, the above polyolefin resin, and the fluidity imparting agent to be described later in 100 mass % of the above organic binder is preferably 90 mass % or more, more preferably 95 mass % or more, and even more preferably 98 mass % or more.

The difference between the thermal decomposition start point (° C.) of the above polyacetal resin and the thermal decomposition start point (° C.) of the above polyolefin resin is preferably 30° C. or more, more preferably 30 to 100° C., from the viewpoint of further reducing cracking and swelling during the degreasing step. The above thermal decomposition start point is the temperature measured using a thermogravimetric differential thermal analyzer.

(Fluidity Imparting Agent)

The composition for use in sintered molded bodies of the present embodiment preferably further contains a fluidity imparting agent. The inclusion of the above fluidity imparting agent further improves the fluidity of the composition for use in sintered molded bodies.

The above fluidity imparting agent is a compound other than the polyacetal resins and polyolefin resins described above, such as waxes. Examples of the above waxes include paraffin wax, polyethylene wax, polypropylene wax, carbana wax, polyethylene glycol, polytetramethylene glycol, polytetraethylene glycol, polyisobutylene, microcrystalline wax, montan-based waxes, wood beeswax, wax, synthetic waxes, poly-1,3-dioxolane, and poly-1,3-dioxepane, for example. Among there, paraffin wax, polyethylene glycol, and polytetramethylene glycol are particularly preferred from the viewpoint of further improving the fluidity of the composition for use in sintered molded bodies during injection molding.

From the viewpoint of achieving further excellent fluidity of the composition for use in sintered molded bodies during injection molding, the mass ratio of the above fluidity imparting agent is particularly 5 to 60 mass %, more preferably 5 to 50 mass %, and particularly preferably 10 to 50 mass %, with respect to 100% mass of the above organic binder.

(Nitrogen-Containing Compound and Fatty Acid Metal Salt)

It is preferred that the above polyacetal resin further contains a nitrogen-containing compound and/or a fatty acid metal salt, and it is more preferred that it contains a nitrogen-containing compound and a fatty acid metal salt.

The inclusion of the above nitrogen-containing compound and the above fatty acid metal salt provides excellent extrudability, thermal stability, and suppression of foreign matters upon production of the polyacetal resin. In addition, the fluidity of the composition for use in sintered molded bodies mixed with the metal powder and the strength of a green molded body tends to be improved at the same time. The inclusion of the above nitrogen-containing compound and the above fatty acid metal salt improves the thermal stability of the composition for use in sintered molded bodies.

Examples of the above nitrogen-containing compound include, but are not particularly limited to, polyamide resins, amide compounds, urea derivatives, and triazine derivatives. Among these, polyamide resins are preferred from the viewpoint of providing further excellent thermal stability of the sintered molded body composition and further excellent strength of a green molded body. They may be used alone or in a combination of two or more.

Examples of the above polyamide resins include, but are not particularly limited to, nylon 6, nylon 11, nylon 12, nylon 66, nylon 6.10, nylon 6/6.10, nylon 6/6.6, nylon 6.6/6.10, nylon 6/6.6/6.10, and poly-β-alanine, for example.

Examples of the above amide compounds include, but are not particularly limited to, stearyl stearate amide, stearyl oleate amide, stearyl erucate amide, ethylenediamine-distearate amide, ethylenediamine-dibehenate amide, hexamethylenediamine-distearate amide, ethylenediamine-dierucate amide, xylylenediamine-dierucate amide, di(xylylenediamine-distearate amide), and sebacic acid amide, which are produced from aliphatic monocarboxylic acids, aliphatic dicarboxylic acids, aromatic monocarboxylic acids, or aromatic dicarboxylic acids, and aliphatic monoamines, aliphatic diamines, aromatic monamines, or aromatic diamines, for example.

Examples of the above urea derivatives include, but are not particularly limited to, N-phenylurea, N,N'-diphenylurea, N-phenylthiourea, and N,N'-diphenylthiourea, for example.

Examples of the above triazine derivatives include, but are not particularly limited to, melamine, benzoguanamine, N-phenylmelamine, melem, N,N'-diphenylmelamine, N-methylolmelamine, N,N'-trimethylolmelamine, 2,4-diamidino-6-cyclohexyltriazine, and melam, for example.

The mass ratio of the above nitrogen-containing compound is preferably 0.005 to 0.2 parts by mass, and particularly preferably 0.005 to 0.1 parts by mass with respect to 100 parts by mass of the polyacetal resin. The mass ratio of the above nitrogen-containing compound in the above range is preferable from the viewpoint that the thermal stability of the polyacetal resin is improved when the sinterable inorganic powder and the organic binder are kneaded.

Examples of the above fatty acid metal salt include, but are not particularly limited to, fatty acid metal salts obtained from a saturated or unsaturated fatty acid having a carbon number of 10 to 35 or fatty acid substituted by a hydroxy group, and a hydroxide, oxide or chloride of an alkali metal or an alkaline earth metal, for example.

Examples of the fatty acids of the above fatty acid metal salts include capric acid, undecylic acid, lauric acid, tridecylic acid, myristic acid, pentadecylic acid, palmitic acid, heptadecylic acid, stearic acid, nonadecanoic acid, arachidic acid, behenic acid, lignoceric acid, cerotic acid, heptacosanoic acid, montanic acid, undecylenic acid, oleic acid, elaidic acid, cetoleic acid, erucic acid, brassidic acid, sorbic acid, linoleic acid, linolenic acid, arachidonic acid, propiolic acid, stearolic acid, 12-hydroxydecanoic acid, 3-hydroxydecanoic acid, 16-hydroxyhexadecanoic acid, 10-hydroxyhexadecanoic acid, 12-hydroxyoctadecanoic acid, and 10-hydroxy-8-octadecanoic acid. Examples of the metal compounds include hydroxides or chlorides of alkali metals such as lithium, sodium, and potassium; alkaline earth metals such as magnesium, calcium, strontium, barium; zinc; or aluminum. Of these, it is preferable that the fatty acid is myristic acid, palmitic acid, or stearic acid and the metal compound is a hydroxide, an oxide, or a chloride of calcium, and calcium myristate, calcium palmitate, or calcium stearate is more preferred.

In cases where the above nitrogen-containing compound and the above fatty acid metal salt are added in the above composition for use in sintered molded bodies, the ratio of the mass of the above fatty acid metal salt to the mass of the above nitrogen-containing compound (mass of the fatty acid metal salt/mass of the nitrogen-containing compound) is preferably within a certain range, and specifically the ratio is 1 to 15, preferably 1 to 10. The ratio of 1 to 15 is preferred because the thermal stability of the polyacetal resin in the organic binder is improved.

<Sinterable Inorganic Powder>

In the present embodiment, the "sinterable inorganic powder" can be selected from any known suitable sinterable inorganic powders. It is preferably selected from metal powders, alloy powders, metal carbonyl powders, and mixtures thereof. Among these, metal powders and ceramic powders are particularly preferred to impart functionality.

One of the above sinterable inorganic powders may be used alone or two or more of these may be used in a combination.

Specific examples of the above metal powders include powders of aluminum, magnesium, barium, calcium, cobalt, zinc, copper, nickel, iron, silicon, titanium, tungsten, and metal compounds and metal alloys based on these. Here, not only already prepared alloys but also mixtures of individual alloy components can be used.

Examples of ceramic powders include oxides such as zinc oxide, aluminum oxide, and zirconia; hydroxides such as hydroxyapatite; carbides such as silicon carbide; nitrides such as silicon nitride and boron nitride; halides such as fluorite; silicates such as stealite; titanates such as barium titanate and lead zirconate titanate; carbonates; phosphates; ferrites; and high-temperature superconductors.

The inorganic powders described above may be used alone, or several inorganic materials such as various metals, metal alloys, or ceramics may be used in combination. Particularly preferred metals and alloy metals include titanium alloys and stainless steels such as SUS316L, and ceramics are exemplified by $Al_2O_3$ and $ZrO_2$.

The average particle diameter of the above inorganic powder is preferably 30 μm or less, more preferably 20 μm or less. The above average particle diameter can be measured, for example, by a particle size analyzer employing the laser diffraction method.

The mass ratio of the above sinterable inorganic powder is preferably 70 to 95 parts by mass, more preferably 75 to 95 parts by mass, and particularly preferably 80 to 95 parts by mass with respect to 100 parts by mass of the above composition for use in sintered molded bodies. When the sinterable inorganic powder is within any of the above ranges, it is possible to obtain a composition for use in sintered molded bodies with a melt viscosity suitable for injection molding and a green molded body with high strength.

<Other Additive>

Other additives that can be added to the above composition for use in sintered molded bodies are not limited as long as they do not impair the effects of the present disclosure, and a preferred additive is an antioxidant.

Examples of the above antioxidant include n-octadecyl-3-(3',5'-di-t-butyl-4'-hydroxyphenyl)propionate, n-octadecyl-3-(3'-methyl-5'-t-butyl-4'-hydroxyphenyl)propionate, n-tetradecyl-3-(3',5'-di-t-butyl-4'-hydroxyphenyl)propionate, 1,6-hexanediol bis-(3-(3,5-di-t-butyl-4-hydroxyphenyl)propionate), 1,4-hutanediol bis-(3-(3,5-di-t-butyl-4-hydroxyphenyl)propionate), 3-(3,5-di-t-butyl-4-hydroxyphenyl)propionic acid, triethylene glycol bis-(3-(3-t-butyl-5-methyl-4-hydroxyphenyl)propionate), tetrakis (methylene 3-(3'-t-butyl-4'-hydroxyphenyl)propionate) methane, N,N'-bis-(3-(3,5-di-t-butyl-4-hydroxyphenyl) propionyl)hydrazine. N,N'-tetramethylene bis-3-(3'-methyl-5'-t-butyl-4'-hydroxyphenyl)propionyl diamine, N,N'-bis-3-(3',5'-di-t-butyl-4'-hydroxyphenol)propionyl hexamethylenediamine, 3-(N-salicyloyl)amino-1,2,4-triazole, N,N'-bis-(2-(3-(3,5-di-t-butyl-4-hydroxyphenyl)propionyloxy)ethyl)oxamide, and N,N'-hexamethylene bis-(3,3,5-t-butyl-4-hydroxyphenyl)propanamide, for example. These antioxidants may be used alone or in a combination of two or more.

The content of the antioxidant is 0.01 to 1.0 parts by mass, preferably 0.05 to 0.5 parts by mass, with respect to 100 parts by mass of the polyacetal resin. The content within the above range improves thermal stability.

The melt flow index of the above composition for use in sintered molded bodies is preferably 80 g/10 min or more and less than 200 g/10 min. more preferably 90 g/10 min or more and less than 180 g/10 min, and even more preferably 90 g/10 min or more and less than 140 g/10 min, as measured under the conditions of 190° C., 2.16 kg in accordance with ASTM-D-1238-57T. A melt flow index of 80 g/10 min or more improves the fluidity of the composition for use in sintered molded bodies, and a melt flow index of less than 200 g/10 min improves the strength of a green molded body.

Note that the melt flow index of the composition for use in sintered molded bodies can be controlled within the above range by, for example, changing the type and the mass ratio of the polyacetal resin used. The melt flow index of the composition for use in sintered molded bodies tends to be high as the melt flow index of the polyacetal resin is high.

[Method of Producing Composition for Use in Sintered Molded Bodies]

The above composition for use in sintered molded bodies can be produced by known methods without any particular limitations. Specifically, the sinterable inorganic powder and the organic binder described above are mixed by, for example, a Henschel mixer, a tumbler, a V-shaped blender, or the like, and then melt-kneaded in a semi-molten state using a single screw extruder or a kneader such as a twin screw extruder, a heating roll, a kneader, and a Banbury mixer. The product can be obtained in various forms, such as strands and pellets.

[Green Molded Body]

The composition for use in sintered molded bodies in the present embodiment can be used as a raw material to be molded when a green molded body, which is a pre-molded body of a sintered molded body, is molded by injection molding. A green molded body can be produced by processing the composition for use in sintered molded bodies in a screw- or piston-type injection molding machine.

It is preferable that the green molded body has at least a portion having a thickness of 1 mm, and it is more preferable that the green molded body has a portion having a thickness of 1 mm and a surface area of 1 $mm^2$. A green molded body having a portion having a thickness of 1 mm and a surface area of 1 $mm^2$ can be obtained by the molding method described above.

(Strength of Green Molded Body)

When a 3-point bending test is performed on the above green molded body obtained by the molding method described above, the product of the value of the maximum bending strength (MPa) and the value of the elastic modulus (MPa) upon 0.05 to 0.1% strain is preferably 50,000 or more, more preferably 100,000 or more. The above maximum bending strength and elastic modulus can be measured by the method described in Examples to be described later.

If the above product of the value of the maximum bending strength and the value of the elastic modulus upon 0.05 to 0.1% strain is less than 50,000, a green molded body produced by injection molding is susceptible to distortion or damage while it is being conveyed.

(Degreasing and Sintering of Green Molded Body)

A sintered molded body can be produced by placing a green molded body in a sealed degreasing and sintering furnace and by degreasing and sintering it under the desired conditions.

In the case of thermal degreasing, degreasing is achieved by raising the temperature from room temperature to 500° C. to 600° C. under a nitrogen atmosphere. The fluidity imparting agent may be eluted into a solvent prior to heating.

The temperature is then raised to the sintering temperature of the sinterable inorganic powder to obtain a sintered molded body.

In the case of degreasing by an acid, degreasing is achieved by circulating nitric acid gas under a nitrogen atmosphere and raising the temperature from room temperature to 110° C. to 120° C.

The temperature is then raised to the sintering temperature of the sinterable inorganic powder to obtain a sintered molded body.

EXAMPLES

The following provides a more detailed description of the present disclosure through specific examples and comparative examples. However, the present disclosure is not limited to the following examples.

The terminology and measurement methods of the properties in the examples and comparative examples are as follows.

[Raw Materials]

(A Polyacetal Resin)

(A-1)

A jacketed twin-shaft paddle type continuous polymerization reactor (manufactured by KURIMOTO, LTD., diameter 2B, L/D=14.8) capable of allowing a heat medium to pass through was set to a temperature of 80° C. A polymerization was caused to take place by continuously feeding, into the polymerization reactor, a catalyst liquid at 69 g/hr which was prepared by diluting boron trifluoride-di-n-butyl etherate as a polymerization catalyst to 0.26 mass % with cyclohexane, trioxane at 3500 g/hr, 1,3-dioxolane at 121 g/hr, and methylal as a molecular weight modifier at 7.1 g/hr.

The product discharged from the polymerization reactor was fed into a 0.5-mass % triethylamine solution to deactivate the polymerization catalyst, which was then filtered, washed, and dried.

Subsequently, the resultant was fed to a twin screw extruder provided with a vent (L/D=40) set to 200° C. In the end stabilization zone, a 0.8-mass % aqueous solution of triethylamine was added in an amount of 20 ppm in terms of the amount of nitrogen, stabilization was carried out while depressurizing and degassing at 90 kPa, and the resultant was pelletized by a pelletizer. Then, the resultant was dried at 100° C. for 2 hours to obtain an (A-1) polyacetal resin.

The resulting (A-1) polyacetal resin had a melting point of 164° C. and a melt flow index of 70 g/10 min.

(A-2)

An (A-2) polyacetal resin was produced in a production method similar to that of the (A-1) polyacetal resin, except that the flow rate of methylal as a molecular weight modifier was set to 7.9 g/hr. The resulting (A-2) polyacetal resin had a melting point of 164° C. and a melt flow index of 90 g/10 min.

(A-3)

An (A-3) polyacetal resin was produced in a production method similar to that of the (A-1) polyacetal resin, except that the flow rate of methylal as a molecular weight modifier was set to 9.4 g/hr. The resulting (A-3) polyacetal resin had a melting point of 164° C. and a melt flow index of 121 g/10 min.

(A-4)

An (A-4) polyacetal resin was produced in a production method similar to that of the (A-1) polyacetal resin, except that the flow rate of methylal as a molecular weight modifier was set to 10.6 g/hr. The resulting (A-4) polyacetal resin had a melting point of 164° C. and a melt flow index of 180 g/10 min.

(A-5)

An (A-5) polyacetal resin was produced in a production method similar to that of the (A-1) polyacetal resin, except that the flow rate of methylal as a molecular weight modifier was set to 11.6 g/hr. The resulting (A-5) polyacetal resin had a melting point of 164° C. and a melt flow index of 213 g/10 min.

(A-6)

An (A-6) polyacetal resin was produced in a production method similar to that of the (A-1) polyacetal resin, except that the flow rate of methylal as a molecular weight modifier was set to 6.9 g/hr. The resulting (A-6) polyacetal resin had a melting point of 164° C. and a melt flow index of 60 g/10 min.

(A-7)

An (A-7) polyacetal resin was produced in a production method similar to that of the (A-1) polyacetal resin, except that 1,4-butanediol formal was used at 121 g/hr in place of 1,3-dioxolane and the flow rate of methylal as a molecular weight modifier was set to 7.1 g/hr. The resulting (A-7) polyacetal resin had a melting point of 164° C. and a melt flow index of 64 g/10 min.

(B Polyolefin Resin)

- B-1: Polypropylene (Sumitomo NOBLEN UH501E1 manufactured by Sumitomo Chemical Co., Ltd., MFR: 100 g/10 min)
- B-2: Polyethylene (SUNTEC™ LDPE M6555 manufactured by Asahi Kasei Corporation, MFR: 55 g/10 min)
- B-3: Polypropylene (NOVATEC PP BC08C manufactured by Japan Polypropylene Corporation, MFR: 60 g/10 min)
- B-4: Polyethylene (Prototype, MFR: 100 g/10 min)

The polyethylene of B-4 was polymerized by the following procedure.

1) Solid Catalyst A

After oxygen and moisture inside an autoclave were removed by dry nitrogen, 1.6 l of a 0.5-mol/l trichlorosilane solution in hexane and 1.2 l of hexane were charged and the temperature was raised to 70° C. Subsequently, 45 l of $Al_{0.15}Mg(n\text{-}Bu)_{1.75}(O\text{-}nBu)_{0.7}$ (an octane solution with a metal concentration of 0.8 mol/l) and 0.35 l of hexane were introduced at 70° C. over 1 hour. Furthermore, 0.6 l of hexane containing 0.7 g of $TiO_4$ was introduced and the reaction was caused to take place at 70° C. for 1 hour. The reaction mixture was filtered and washed with hexane. This was used as a solid catalyst A.

2) Solid Catalyst B

An autoclave was charged with 3.0 mol of a reaction product with Si/Mg=1.0/1.0 of $(C_2H_5)(n\text{-}C_4H_9)Mg$, hydromethylpolysiloxane with a viscosity of 15 centistokes, and 3.0 mol of titanium tetrachloride, together with 6 l of hexane, and a reaction was caused to take place at −10° C. for 3 hours. The reaction mixture was subjected to a post-treatment in the same manner as in the solid catalyst A to obtain a solid catalyst B.

3) Polymerization of Polyethylene with MFR of 100 g/10 Min

Two reactors having a volume of 100 l were connected in series. The following were continuously fed to the first reactor: the solid catalyst A at 0.20 g/hr, triisobutylaluminum ($Al(i\text{-}C_4H_9)_3$) at 2.5 mmol/hr, a cyclohexane solvent at 100 l/hr, ethylene at 8 kg/hr, 1-butene at 5 kg/hr, and hydrogen at 1.0 l/hr. The polymerization solution was continuously taken out of the first reactor and fed to the second reactor. At the same time, the following were continuously fed to the second reactor to carry out polymerization: the solid catalyst B at 0.10 g/hr, triisobutylaluminum ($Al(i\text{-}C_4H_9)_3$) at 1.5 mmol/hour, cyclohexane at 50 l/hour, ethylene at 4 kg/hr, and hydrogen at 0.03 l/hr. The polymerization was cause to take place while the temperature of the first reactor was set to 140° C. and the temperature of the second reactor was set to 180° C. The MFR of the resulting ethylene-1-butene copolymer was 100 g/10 min.

(C Nitrogen-Containing Compound)

Nylon 66 (Molecular weight: 10000)

(D Fatty Acid Metal Salt)

Calcium stearate (E Fluidity Imparting Agent)

E-1: Paraffin wax (Paraffin wax-145 manufactured by NIPPON SEIRO CO., LTD.)

E-2: Polyethylene glycol (manufactured by Sigma-Aldrich)

E-3: Polytetramethylene glycol (manufactured by Mitsubishi Chemical Corporation)

[Production of Composition for Use in Sintered Molded Bodies]

To 100 parts by mass of each polyacetal resin (A-1) to (A-7), 0.05 parts by mass of the (C) nylon 66 and 0.3 parts by mass of the (D) calcium stearate were uniformly added and mixed, which was fed to a twin screw extruder provided with a vent (L/D=40) set to 200° C. and was pelletized while degassing under reduced pressure at 90 kPa. Then, the resultant was dried at 100° C. for 2 hr.

A composition for use in sintered molded bodies was prepared by using SUS316L (average particle diameter: 10 μm) as the sinterable inorganic powder, and blending the above polyacetal resin composition, the (B) polyolefin resin, and the (E) fluidity imparting agent in the proportions summarized in Tables 1 and 2.

[Evaluations]

(Melt Flow Index (MI))

The MI (melt flow index: g/10 min) was measured under the conditions of 190° C., 2160 g in accordance with ASTM-D-1238 using MELT INDEXER manufactured by Toyo Seiki Co., Ltd.

(Molding of Green Molded Body)

Each of the compositions for use in sintered molded bodies according to Examples 1 to 18 and Comparative Examples 1 to 11 was mixed in a pressing kneader at 170° C. for 1 hour, then the mixed material was cooled and pulverized to obtain a raw material for injection molding, which was then molded in an injection molding machine (ROBOSHOT α-50iA manufactured by FANUC CORPORATION) at a molding temperature of 175 to 200° C. to obtain a green molded body specimen in the shape of a dumbbell in accordance with ISO 10724-1. The thickness of this specimen can be varied from 1 mm to 2 mm.

(Moldability)

The extent of ease of molding when the green molded body was molded was evaluated according to the following criteria.

○ (good): molded bodies were sampled without problems

Δ (partially poor): cracks were occasionally found on the edges of molded bodies X (poor): molded bodies without cracks could not be sampled.

(Strength of Green Molded Body)

The strength of each green molded body was tested in a three-point bending test. Specifically, the maximum strength and the elastic modulus were measured when the above dumbbell specimen was descended using an autograph (Dual column flore model 5581 manufactured by Instron) at a speed of a load cell of 2 mm/minute with a support jig interval set to 50 mm. The product of the maximum bending strength (MPa) and the elastic modulus (MPa) was calculated and an evaluation was made based on the value of the product according to the following criteria ◎ (excellent): 100,000 or more ○ (good): less than 100,000 and 50,000 or more X (poor): less than 50,000

Note that compositions for use in sintered molded bodies having a high product of the maximum bending strength and the elastic modulus indicate that they are less susceptible to plastic deformation, and are therefore suitable materials for green molded bodies because permanent strain is less likely to remain.

(Degreasability)

(Acid Degreasing)

Degreasing was carried out using an acid in Examples 1 to 6 and Comparative Examples 1 to 4. The green molded bodies were set in a degreasing furnace while being supported at two points with an interval of 50 mm. The above furnace was first heated to 110° C. and the inside was replaced with nitrogen at 500 l/hr for 30 minutes. Then, 98% nitric acid was supplied at 30 ml/hr while the nitrogen purge was kept. Degreasing was carried out. The conditions were as follows: the acid was kept to be fed for 2.5 hours; subsequently, the inside of the furnace was replaced with 500 l/hr of nitrogen for 45 minutes, and the temperature was reduced to room temperature. The appearance of the degreased green molded bodies was visually observed and evaluated according to the following criteria.

○ (good): no abnormalities in appearance such as cracking or swelling were observed X (poor): abnormalities in appearance such as cracking or swelling were observed

- (not performed): injection molding could not be performed.

(Thermal Degreasing)

Thermal degreasing was carried out in Examples 7 to 18 and Comparative Examples 5 to 11. The green molded bodies were set in a degreasing furnace while being supported at two points with an interval of 50 mm. Then, degreasing was carried out by purging the inside of the degreasing furnace with nitrogen gas, raising the temperature to 500° C. at a rate of 30° C./hr as the first condition or 45° C./hr as the second condition, and maintaining the temperature to 500° C. for 2 hours. The appearance of the degreased green molded bodies were visually observed and evaluated according to the following criteria.

○ (excellent): no abnormalities in appearance such as cracking or swelling were observed under both the first condition and the second condition.

Δ (good): no abnormalities in appearance such as cracking or swelling were observed under the first condition, but cracking and/or swelling were observed under the second condition.

X (poor): cracking and/or swelling were observed under both the first condition and the second condition.

- (not performed): injection molding could not be performed.

TABLE 1

| | | Example 1 | Example 2 | Example 3 | Example 4 | Example 5 | Example 6 | Comp. Example 1 | Comp. Example 2 | Comp. Example 3 | Comp. Example 4 |
|---|---|---|---|---|---|---|---|---|---|---|---|
| Type of polyacetal resin | — | A-1 | A-2 | A-3 | A-4 | A-3 | A-3 | A-7 | A-5 | A-6 | A-5 |
| SUS316L powder | mass % | 90 | 90 | 90 | 90 | 90 | 90 | 90 | 90 | 90 | 90 |
| Polyacetal resin composition | mass % | 8 | 8 | 8 | 8 | 8 | 9 | 8 | 8 | 8 | 9 |
| Polypropylene resin (B-1) | mass % | 1 | 1 | 1 | 1 | — | — | 1 | 1 | 1 | 1 |
| Polypropylene resin (B-3) | mass % | — | — | — | — | 1 | | — | — | — | — |
| Polyethylene resin (B-4) | mass % | — | — | — | — | — | 1 | — | — | — | — |
| Polytetramethylene glycol | mass % | 1 | 1 | 1 | 1 | 1 | | 1 | 1 | 1 | — |
| Molding temperature | ° C. | 195 | 190 | 180 | 175 | 180 | 180 | 175 | 190 | 200 | 190 |
| Moldability (specimen of 1 mm) | — | ○ | ○ | ○ | ○ | Δ | ○ | ○ | ○ | × | × |
| Moldability (specimen of 2 mm) | — | ○ | ○ | ○ | ○ | ○ | ○ | ○ | ○ | × | × |
| Evaluation of strength of molded body (specimen of 1 mm) | — | ◎ | ◎ | ○ | ○ | ○ | ○ | × | × | — | — |
| Evaluation of strength of molded body (specimen of 2 mm) | — | ◎ | ◎ | ◎ | ○ | ○ | ○ | × | × | — | — |
| Degreasability (acid degreasing) | — | ○ | ○ | ○ | ○ | ○ | ○ | ○ | × | — | — |

| | | Example 7 | Example 8 | Example 9 | Example 10 | Example 11 | Example 12 | Example 13 | Example 14 |
|---|---|---|---|---|---|---|---|---|---|
| Type of polyacetal resin | — | A-1 | A-1 | A-2 | A-3 | A-3 | A-3 | A-3 | A-4 |
| SUS316L powder | mass % | 80 | 90 | 90 | 90 | 90 | 90 | 90 | 90 |
| Polyacetal resin composition | mass % | 5 | 2.5 | 2.5 | 2.5 | 3 | 3 | 5 | 3 |
| Polypropylene resin (B-1) | mass % | 5 | 2.5 | 2.5 | 2.5 | 3 | 3 | 1 | 3 |
| Polyethylene resin (B-2) | mass % | — | — | — | — | — | — | — | — |
| Polypropylene resin (B-3) | mass % | — | — | — | — | — | — | — | — |
| Polyethylene resin (B-4) | mass % | — | — | — | — | — | — | — | — |
| Paraffin wax | mass % | 10 | 5 | 5 | 5 | 4 | — | 4 | 4 |
| Polyethylene glycol | mass % | — | — | — | — | — | 4 | — | — |
| Molding temperature | ° C. | 190 | 190 | 185 | 180 | 180 | 180 | 180 | 175 |
| Evaluation of mMoldability (specimen of 1 mm) | — | ○ | ○ | ○ | ○ | ○ | ○ | ○ | ○ |
| Evaluation of moldability (specimen of 2 mm) | — | ○ | ○ | ○ | ○ | ○ | ○ | ○ | ○ |
| Evaluation of strength of molded body (specimen of 1 mm) | — | ○ | ◎ | ◎ | ○ | ○ | ○ | ◎ | ○ |

-continued

| | | | | | | | | | |
|---|---|---|---|---|---|---|---|---|---|
| Evaluation of strength of molded body (specimen of 2 mm) | — | ○ | ◎ | ◎ | ○ | ◎ | ◎ | ◎ | ○ |
| Degreasability (thermal degreasing) | — | Δ | ○ | ○ | ○ | ○ | ○ | ○ | ○ |

| | | Example 15 A-4 | Comp. Example 5 | Example 16 | Example 17 | Example 18 | Comp. Example 6 | Comp. Example 7 | Comp. Example 8 |
|---|---|---|---|---|---|---|---|---|---|
| Type of polyacetal resin | — | A-4 | A-7 | A-3 | A-3 | A-3 | A-6 | A-6 | A-5 |
| SUS316L powder | mass % | 90 | 90 | 90 | 90 | 90 | 80 | 80 | 90 |
| Polyacetal resin composition | mass % | 5 | 3 | 2.5 | 3 | 3 | 5 | 2.5 | 3 |
| Polypropylene resin (B-1) | mass % | 4 | 3 | — | — | — | 5 | 2.5 | 3 |
| Polyethylene resin (B-2) | mass % | — | — | 2.5 | — | — | — | — | — |
| Polypropylene resin (B-3) | mass % | — | — | — | 3 | — | — | — | — |
| Polyethylene resin (B-4) | mass % | — | — | — | — | 3 | — | — | — |
| Paraffin wax | mass % | 1 | 4 | 5 | — | 4 | 10 | 15 | 4 |
| Polyethylene glycol | mass % | — | — | — | 4 | — | — | — | — |
| Molding temperature | ° C. | 175 | 190 | 180 | 180 | 180 | 190 | 180 | 175 |
| Evaluation of mMoldability (specimen of 1 mm) | — | ○ | ○ | ○ | ○ | ○ | × | × | ○ |
| Evaluation of moldability (specimen of 2 mm) | — | ○ | ○ | ○ | ○ | ○ | ○ | × | × |
| Evaluation of strength of molded body (specimen of 1 mm) | — | ◎ | × | ○ | ○ | ○ | — | — | × |
| Evaluation of strength of molded body (specimen of 2 mm) | — | ◎ | × | ○ | ○ | ◎ | × | — | — |
| Degreasability (thermal degreasing) | — | ○ | ○ | ○ | Δ | ○ | × | — | — |

| | | Comp. Example 9 | Comp. Example 10 | Comp. Example 11 |
|---|---|---|---|---|
| Type of polyacetal resin | — | A-5 | A-3 | — |
| SUS316L powder | mass % | 90 | 90 | 90 |
| Polyacetal resin composition | mass % | 6 | 5 | — |
| Polypropylene resin (B-1) | mass % | 4 | — | 5 |
| Polyethylene resin (B-2) | mass % | — | — | — |
| Polypropylene resin (B-3) | mass % | — | — | — |

-continued

| | | | | |
|---|---|---|---|---|
| Polyethylene resin (B-4) | mass % | — | — | — |
| Paraffin wax | mass % | — | 5 | 5 |
| Polyethylene glycol | mass % | — | — | — |
| Molding temperature | ° C. | 180 | 180 | 180 |
| Evaluation of mMoldability (specimen of 1 mm) | — | ○ | × | × |
| Evaluation of moldability (specimen of 2 mm) | — | ○ | × | × |
| Evaluation of strength of molded body (specimen of 1 mm) | — | × | — | — |
| Evaluation of strength of molded body (specimen of 2 mm) | — | × | — | — |
| Degreasability (thermal degreasing) | — | × | — | — |

The invention claimed is:

1. A composition for producing sintered molded bodies by acid degreasing to remove a binder from green molded bodies comprising:

a sinterable metal powder and an organic binder, wherein the organic binder comprises at least a polyacetal resin and a polyolefin resin, a melt flow index of the polyacetal resin is 70 to 200 g/10 min, the polyolefin resin is selected from a group consisting of polyethylene, polypropylene, and mixtures thereof, and a mass ratio of the polyolefin resin with respect to 100 parts by mass of the polyacetal resin is 10 to 200 parts by mass.

2. The composition according to claim 1, wherein a melt flow index (190° C., 2.16 kg) of the polyolefin resin is 40 g/10 min or more.

3. The composition according to claim 1, wherein the organic binder comprises 5 to 95 mass % of the polyacetal resin and 5 to 95 mass % of the polyolefin resin, based on a mass of the organic binder.

4. The composition according to claim 1, wherein the composition comprises 70 to 95 parts by mass of the sinterable metal powder when the composition is taken as 100 parts by mass.

5. The composition according to claim 1, wherein the organic binder comprises 5 to 60 mass % of a fluidity imparting agent, based on the mass of the organic binder.

6. The composition according to claim 1, wherein the polyacetal resin comprises an oxymethylene unit and an oxyethylene unit.

7. The composition according to claim 1, wherein the organic binder comprises a nitrogen-containing compound and a fatty acid metal salt.

8. A green molded body produced by molding the composition according to claim 1.

9. The green molded body according to claim 8, wherein the green molded body has a portion with a surface area of 100 $mm^2$ or more having a thickness of 1 mm or less.

10. A method of manufacturing a sintered molded body, the method comprising:

molding the composition according to claim 1 to obtain a green molded body, degreasing the green molded body by acid; and sintering the degreased green molded body.

11. A composition for producing sintered molded bodies by thermal degreasing to remove a binder from green molded bodies comprising:

a sinterable metal powder and an organic binder, wherein the organic binder comprises at least a polyacetal resin and a polyolefin resin, a melt flow index of the polyacetal resin is 70 to 200 g/10 min, and a mass ratio of the polyacetal resin in the organic binder is 5 to 45% by mass with respect to 100% by mass of the organic binder.

12. The composition according to claim 11, wherein a melt flow index (190° C., 2.16 kg) of the polyolefin resin is 40 g/10 min or more.

13. The composition according to claim 11, wherein the composition comprises 70 to 95 parts by mass of the sinterable metal powder when the composition is taken as 100 parts by mass.

14. The composition according to claim 11, wherein the organic binder comprises 5 to 60 mass % of a fluidity imparting agent, based on the mass of the organic binder.

15. The composition according to claim 11, wherein the polyacetal resin comprises an oxymethylene unit and an oxyethylene unit.

16. The composition according to claim 11, wherein the organic binder comprises a nitrogen-containing compound and a fatty acid metal salt.

17. A green molded body produced by molding the composition according to claim 11.

18. The green molded body according to claim 17, wherein the green molded body has a portion with a surface area of 100 $mm^2$ or more having a thickness of 1 mm or less.

19. A method of manufacturing a sintered molded body, the method comprising:

molding the composition according claim 11 to obtain a green molded body, degreasing the green molded body by heat; and sintering the degreased green molded body.

20. The composition according to claim 1, wherein the organic binder comprises 5 to 50 mass % of the polyacetal resin, based on the mass of the organic binder.

* * * * *